United States Patent [19]

Storie

[11] Patent Number: 4,627,111

[45] Date of Patent: Dec. 9, 1986

[54] BODY SUIT

[76] Inventor: Lyndola M. Storie, 1739 Cherokee, Caseyville, Ill. 62232

[21] Appl. No.: 768,236

[22] Filed: Aug. 22, 1985

[51] Int. Cl.[4] ..... A41B 1/12

[52] U.S. Cl. ..... 2/69

[58] Field of Search ..... 2/67, 69; 128/519

[56] References Cited

U.S. PATENT DOCUMENTS 2,100,869 11/1937 Ocard ..... 2/115

3,712,308 1/1973 Herbener ..... 128/519

*Primary Examiner*—Doris L. Troutman

[57] ABSTRACT

A body suit constructed of thin, flexible, porous, resilient material such as latex rubber or the like constructed to fit an existing human female body in skintight relation with the external surface of the body suit closely simulating the color and skin texture of the wearer so that it is substantially indiscernible to an observer. The body suit includes breast areas, a navel and pubic hair simulative of a human female body and a crotch opening enabling normal body functions to be performed including coital intercourse without removing the body suit. The breast areas may include pockets receiving existing breasts or padding or prosthesis to augment small or flat breasts or replace breasts which may have been removed as a result of a mastectomy thereby enabling the wearer to eliminate psychological barriers to removal of clothing or garments and enabling the wearer to be more satisfied with their personal appearance and enabling greater satisfaction from sexual coitus.

2 Claims, 3 Drawing Figures

FIG. 1
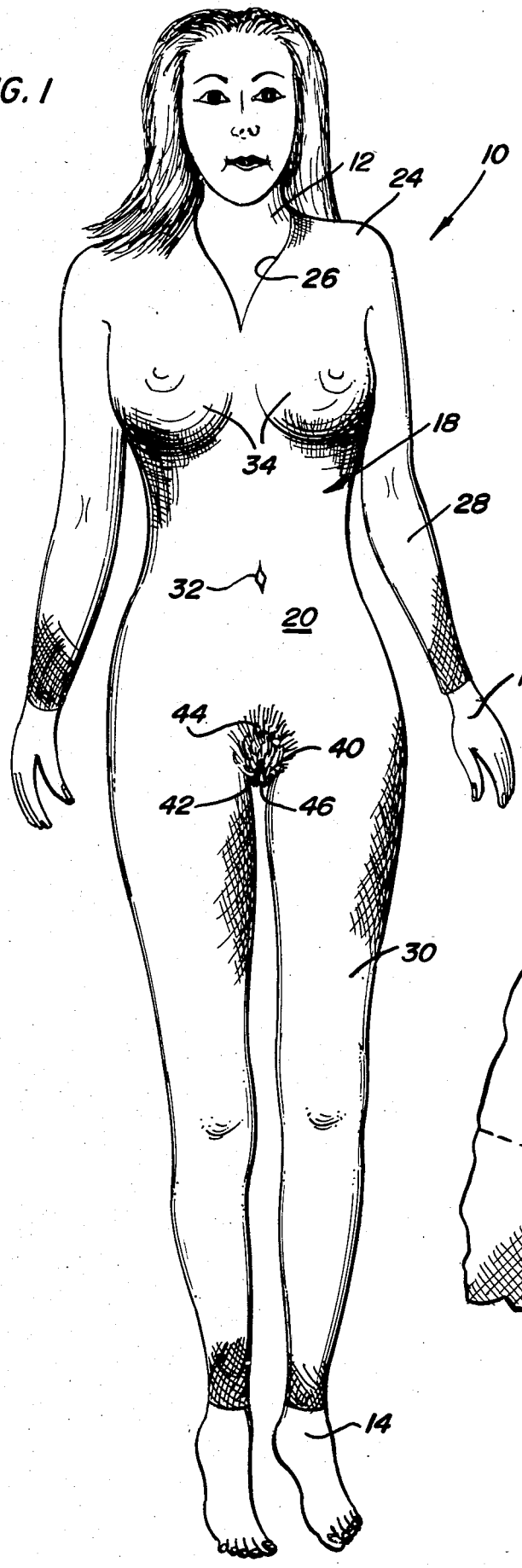
FIG. 2
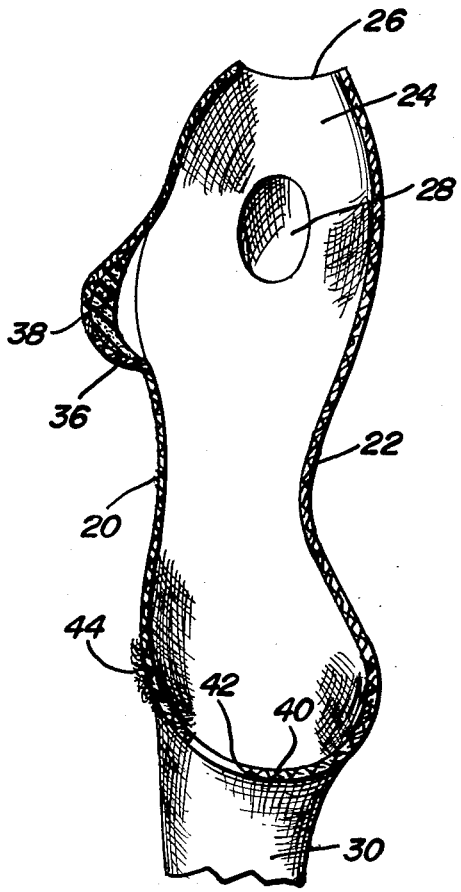
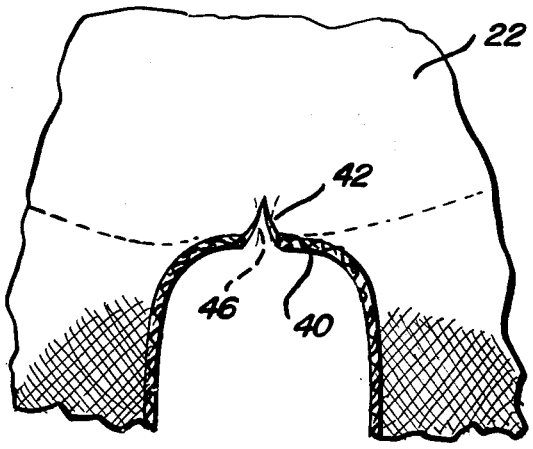
FIG. 3

BODY SUIT

BACKGROUND OF THE INVENTION

1. Field of the Invention

The present invention relates to a body suit constructed of very thin and flexible porous material such as latex rubber or the like and which fits the body of the wearer in a skintight manner. The body suit is constructed as closely simulative as possible to the appearance characteristics of the skin of a person's body with the texture and color of the body suit being closely simulative of the actual skin surface. The body suit is primarily intended to cover body imperfections, disfigurements and the like such as scars, stretch marks in the abdomen region, mastectomies, moles and reshapes hips, abdomen areas and small or flat breasts thereby providing an external appearance closely simulative of a natural body surface having optimum shape and size characteristics.

2. Information Disclosure Statement

Many efforts have been made to shape the exterior of certain portions of the human anatomy and to replace removed components by providing prostheses. However, such efforts have generally been restricted to a localized area of the body. For example, if a breast is removed as a result of a mastectomy, brassieres can be worn having a simulated breast or breasts incorporated therein. Also, the chest area having the breast removed therefrom can be rebuilt by skin grafts, silicone inserts and the like. Also, various under garments have been provided to reshape the abdomen area, hip area and the like by compressing such areas or in some instances adding padding to increase the size of such areas. However, such devices have a limited degree of success since they involve only one local area of the human body and frequently are removable which sometimes results in psychological problems for the person when it becomes necessary or desirable to remove all articles of clothing.

SUMMARY OF THE INVENTION

An object of the present invention is to provide a complete, skintight body suit, closely simulative of a naked, female human body constructed of porous, stretch film of latex rubber, plastic or the like constructed in such a manner that when worn, the body of the wearer will closely simulate the size, shape and appearance of a theoretically perfect human body.

Another object of the invention is to provide a body suit in accordance with the preceding object constructed of natural skin colors with natural skin texture to fit the wearer in skintight condition from neck to toe or ankle or from neck to crotch area to cover the entire torso depending upon the needs of desires of the wearer with the body suit covering unsightly or disfigured body areas and including pockets for breasts or built in simulated breasts in the event of a mastectomy or small or flat breasts as well as navel, pubic hair and a crotch opening enabling natural elimination of body waste and coital intercourse in a normal manner while the body suit is being worn.

A further object of the invention is to provide a body suit having a V-neck opening with long or short sleeves to enable the body suit to be worn at times when the wearer desires to produce the image or illusion that the body has optimum external appearance characteristics with the body suit being relatively inexpensive to construct, easily used, capable of being worn for relative long periods of time and effective for alleviating psychological barriers to persons having real or imagined body disfigurements and unsightly areas when it become necessary or desirable for such a person to remove all articles of clothings.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a front elevational view of the body suit of the present invention.

FIG. 2 is a vertical sectional view through the torso area of the body suit.

FIG. 3 is a fragmental transverse sectional view of the crotch area of the body suit.

DESCRIPTION OF THE PREFERRED EMBODIMENT

Referring now specifically to the drawings, the body suit of the present invention is generally designated by reference numeral 10 and in the embodiment illustrated, the body suit closely fits and engages in skintight relation, the body of the wearer from the neck region 12 to the ankles 14 and includes sleeves covering the arms to the wrist area 16.

The body suit 10 includes a torso enclosing area 18 including integral or one piece front and rear panels 20 and 22 which are interconnected by shoulder regions 24 at the upper end thereof with their being provided a neck opening 26 which may be a V-shaped neck opening or scoop-type neck opening or even a turtle neck opening having sufficient size and resiliency to enable the body suit to be pulled upwardly onto the body of the wearer. As illustrated, long sleeves 28 extend from the shoulder covering areas 24 to the wrist area 16 of the wearer although other embodiments of the invention may be provided with short sleeves terminating above the elbow or sleeveless terminating at the outer edge of the shoulder region 24. The embodiment illustrated also includes elongated leg covering members 30 integral with the torso panels 20 and 22 which extend to the ankle region 14 of the wearer as illustrated in FIG. 1. In other embodiments, the leg covering members 30 may be at calf length, above the knee or terminate at the hips in either a generally horizontal terminal edge or an upwardly inclined terminal edge similar to various types of leg openings in panties, swimsuits and the like which fit skintight with respect to the hip area and slant upwardly into varying shapes to expose substantial portions of the side surfaces of the hip areas.

The front panel 20 of the torso covering area 18 includes a simulative navel 32 and breast areas 34 which are in the form of projections 36 having padding or prosthesis insert 38 built therein to replace the natural breasts in the event of a mastectomy or supplement the natural breasts when the breast is small or flat to provide breast areas having size and shape characteristics desired by the wearer with the shape and resilient consistency of the breast areas 34 closely simulating natural breasts in appearance and in "feel" so that manual or oral manipulation, such as may occur during coital intercourse, will provide all of the characteristics and satisfaction of natural breasts.

The torso covering area 18 of the body suit 10 includes a crotch covering area 40 having a front-to-rear opening 42 and provided with simulative pubic hair 44. The opening 42 is approximately 3 inches in length or more depending upon the size characteristics of the wearer to enable normal bodily functions to be performed, such as eliminating body waste in a normal manner and enabling coital intercourse to be conducted in a normal manner without removal of the body suit. The side edges of the opening 42 are normally spaced apart a distance to receive and expose the labia 46 of the vagina thereby facilitating normal coital intercourse while the body suit is being worn.

The body suit is constructed of one piece of material or may be constructed or several pieces of material joined together by seaming, stitching or the like and is preferably constructed of thin latex rubber, plastic film or the like which is very thin and very flexible and is constructed of porous, resilient material to enable it to stretch to fit the surfaces of the body in a skintight relationship with the porosity enabling the body suit to breathe by passage of air through small openings provided through the material from which the body suit is constructed. The body suit has all of the appearance characteristics of a naked human body as to the skin color and texture and covers unsightly body areas and conceals real or imagined disfigurements and objectionable appearance characteristics. The body suit may extend from neck to toe, neck to ankle or neck to crotch area and may include long sleeves, short sleeves or be sleeveless depending upon the desires and needs of the wearer. The body suit includes all of the appearance characteristics of a human body including a navel, breast areas 34 which includes pockets or built in simulated breasts, a crotch opening for natural functions and pubic hair. The neck opening may be a V-neck, scoop neck or the like enabling the garment to be pulled upwardly over the legs and hip area when placing the garment in position. The specific construction of the body suit enables it to be effectively worn prior to and during sexual intercourse since it presents a human body having optimum physical characteristics with all body imperfections being completely covered, concealed, replaced or reshaped thereby providing optimum satisfaction from such activities.

As indicated, the material from which the body suit may be constructed may be a latex rubber film, plastic film or elasticized fabric having desirable stretch characteristics and capable of being easily placed on the human body and removed therefrom and capable of being laundered to maintain desired sanitary conditions.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A body suit for enclosing and completely covering the torso area of a female human wearer in skintight relation comprising a torso enclosing member consisting only of a front panel and a rear panel of integral construction and provided with shoulder engaging regions, a neck opening, arm openings and a crotch area with leg openings, said torso enclosing member being constructed of thin, flexible porous resilient material having external appearance, surface texture, feel and shape characteristics closely simulative of ideal physical appearance, shape and size characteristics of a natural torso of a female human body with the body suit covering unsightly body areas such as stretch marks, scars, moles and the like, said front panel including pockets receiving the natural breasts, if present, and breast prostheses to provide replacement breasts in the event of mastectomies or enhance breast size and shape, said crotch area including an opening extending longitudinally from front to rear to enable normal body functions to be performed including coital intercourse while the body suit is being worn without requiring removal of any garments, said torso enclosing member including a simulative navel in the front panel and simulated pubic hair in the crotch area and front panel to provide all of the appearance characteristics of a natural naked human female body.

2. The body suit as defined in claim 1 wherein said crotch opening is defined by spaced side edges oriented outwardly of the vaginal labia for exposure to the labia to enable normal coital intercourse without interference from the body suit.

* * * * *